US011371378B2

(12) United States Patent
Lee et al.

(10) Patent No.: US 11,371,378 B2
(45) **Date of Patent: *Jun. 28, 2022**

(54) APPARATUS FOR CONTROLLING TURBINE BLADE TIP CLEARANCE AND GAS TURBINE INCLUDING THE SAME

(71) Applicant: DOOSAN HEAVY INDUSTRIES & CONSTRUCTION CO., LTD., Changwon-si (KR)

(72) Inventors: Seung Min Lee, Changwon (KR); Yong Hwan Kwon, Seoul (KR); Dong Il Kim, Yongin (KR); Jin Woong Ha, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/204,947

(22) Filed: Mar. 18, 2021

(65) Prior Publication Data

US 2021/0348519 A1 Nov. 11, 2021

(30) Foreign Application Priority Data

Mar. 31, 2020 (KR) ..... 10-2020-0038943

(51) Int. Cl.
*F01D 11/24* (2006.01)
*F01D 25/14* (2006.01)

(52) U.S. Cl.
CPC ..... *F01D 11/24* (2013.01); *F01D 25/14* (2013.01); *F05D 2260/22141* (2013.01); *F05D 2260/232* (2013.01)

(58) Field of Classification Search
None
See application file for complete search history.

(56) References Cited

U.S. PATENT DOCUMENTS 5,167,488 A * 12/1992 Ciokajlo ..... F01D 25/246 415/175
5,211,407 A * 5/1993 Glynn ..... F01D 11/006 277/632
7,517,189 B2 * 4/2009 Camus ..... F01D 9/04 415/173.1
8,177,492 B2 * 5/2012 Knapp ..... F01D 11/08 415/173.1
8,480,353 B2 * 7/2013 Koyabu ..... F01D 9/04 415/116
8,684,680 B2 * 4/2014 Martin ..... F01D 25/246 415/173.1

(Continued)

FOREIGN PATENT DOCUMENTS

JP 2016520757 A 7/2016
KR 1020070051749 A 5/2007
KR 101957590 B1 6/2019

OTHER PUBLICATIONS

KR OA dated Apr. 28, 2021.

*Primary Examiner* — Michael Lebentritt
(74) *Attorney, Agent, or Firm* — Harvest IP Law, LLP

(57) ABSTRACT

An apparatus for controlling tip clearance between a turbine casing and a turbine blade is provided. The apparatus for controlling tip clearance includes a casing surrounding the turbine blade, a cooling plate installed in a groove, formed in a circumferential direction in the casing, and contracted by cold air supplied thereto, the cooling plate having at least one fin formed on an outer peripheral surface thereof, and a ring segment mounted radially inside the cooling plate.

20 Claims, 11 Drawing Sheets

(56) References Cited

U.S. PATENT DOCUMENTS

| | | | | |
|---|---|---|---|---|
| 10,208,617 | B2 | 2/2019 | Jones et al. | |
| 10,570,773 | B2 * | 2/2020 | Synnott | F01D 9/04 |
| 2004/0047725 | A1 * | 3/2004 | Tomita | F01D 11/005 415/116 |
| 2010/0159814 | A1 * | 6/2010 | Corn | H02K 15/00 451/552 |
| 2017/0058684 | A1 * | 3/2017 | Correia | F01D 25/005 |
| 2018/0347391 | A1 | 12/2018 | Lewis et al. | |
| 2019/0120081 | A1 * | 4/2019 | Kim | F01D 11/08 |
| 2020/0408108 | A1 * | 12/2020 | Jang | F01D 25/14 |
| 2021/0246805 | A1 * | 8/2021 | Jang | F01D 11/08 |
| 2021/0301674 | A1 * | 9/2021 | Lee | F01D 11/24 |

* cited by examiner

APPARATUS FOR CONTROLLING TURBINE BLADE TIP CLEARANCE AND GAS TURBINE INCLUDING THE SAME

CROSS-REFERENCE TO RELATED APPLICATION

This application claims priority to Korean Patent Application No. 10-2020-0038943, filed on Mar. 31, 2020, the disclosure of which is incorporated herein by reference in its entirety.

BACKGROUND

Technical Field

Apparatuses and methods consistent with exemplary embodiments relate to an apparatus for controlling turbine blade tip clearance and a gas turbine including the same.

Related Art

Turbines are machines that obtain a rotational force by impingement or reaction force using a flow of a compressible fluid such as steam or gas, and include a steam turbine using steam, a gas turbine using hot combustion gas, and so on.

The gas turbine includes a compressor, a combustor, and turbine. The compressor has an air inlet for introduction of air thereinto, and includes a plurality of compressor vanes and a plurality of compressor blades alternately arranged in a compressor casing.

The combustor supplies fuel to air compressed by the compressor and ignites a mixture thereof with a burner to produce high-temperature and high-pressure combustion gas.

The turbine includes a plurality of turbine vanes and a plurality of turbine blades alternately arranged in a turbine casing. In addition, a rotor is disposed to pass through centers of the compressor, the combustor, the turbine, and an exhaust chamber.

The rotor is rotatably supported at both ends thereof by bearings. The rotor has a plurality of disks fixed thereto, and a plurality of blades are connected to each of the disks while a drive shaft of a generator is connected to an end of the exhaust chamber.

The gas turbine is advantageous in that consumption of lubricant is extremely low due to an absence of mutual friction parts such as a piston-cylinder because the gas turbine does not have a reciprocating mechanism such as a piston in a four-stroke engine. Therefore, an amplitude, which is a characteristic of reciprocating machines, is greatly reduced, and the gas turbine has an advantage of high-speed motion.

The operation of the gas turbine is briefly described. That is, the air compressed by the compressor is mixed with fuel for combustion to produce high-temperature and high-pressure combustion gas which is injected into the turbine, and the injected combustion gas generates a rotational force while passing through the turbine vanes and turbine blades, thereby rotating the rotor.

In this case, a gap defined as a tip clearance is formed between the turbine casing and each of the plurality of blades. If the tip clearance is increased above an acceptable level, an amount of combustion gas that is not activated and is discharged between the turbine casing and the blade, reducing an overall efficiency of the gas turbine. In contrast, if the tip clearance decreases below an appropriate level, the blade may scratch the inner wall of the turbine casing. Therefore, adjusting the tip clearance of the turbine to an appropriate level is closely related to improving the performance of the gas turbine.

SUMMARY

Aspects of one or more exemplary embodiments provide an apparatus for controlling turbine blade tip clearance, which allows a cooling plate to have an improved shape to supply cold air more efficiently, thereby enabling the cooling plate to contract further in a radial direction, and a gas turbine including the same.

Additional aspects will be set forth in part in the description which follows and, in part, will become apparent from the description, or may be learned by practice of the exemplary embodiments.

According to an aspect of an exemplary embodiment, there is provided an apparatus for controlling tip clearance between a turbine casing and a turbine blade, the apparatus including: a casing surrounding the turbine blade, a cooling plate installed in a groove, formed in a circumferential direction in the casing, and contracted by cold air supplied thereto, the cooling plate having at least one fin formed on an outer peripheral surface thereof, and a ring segment mounted radially inside the cooling plate.

The cooling plate may include a body disposed in the groove of the casing, a mounting groove formed radially inside the body, a pair of side walls extending outward from both sides on a radially outer peripheral surface of the body, and the fin extending upward from an outer peripheral surface of the body.

The fin may be in a form of a rib disposed in the center between the pair of side walls.

The fin may be higher than radial heights of the side walls.

The cooling plate may further include mounting ribs extending outwardly from upper ends of the pair of side walls.

The fin may include two or more ribs formed between the pair of side walls.

The fin may include two ribs having a same height as the side wall and formed between the pair of side walls, and one rib having a height lower than that of the two ribs and formed between the two ribs.

The fin may be in a form of a rib disposed in a center between the pair of side walls, and may include a through-hole formed in a middle of the rib.

The through-hole may be formed to be inclined at a predetermined angle with respect to a width direction of the cooling plate.

The pair of side walls may have grooves or holes formed on inner surfaces thereof.

According to an aspect of another exemplary embodiment, there is provided a gas turbine including: a compressor configured to compress outside air, a combustor configured to mix fuel with the air compressed by the compressor to burn a mixture thereof, a turbine comprising a plurality of turbine blades in a turbine casing rotated by combustion gas discharged from the combustor to generate power, and an apparatus for controlling tip clearance between the turbine casing and the turbine blade. The apparatus for controlling tip clearance may include a casing surrounding the turbine blade, a cooling plate installed in a groove, formed in a circumferential direction in the casing, and contracted by cold air supplied thereto, the cooling plate having at least one fin formed on an outer peripheral surface thereof, and a ring segment mounted radially inside the cooling plate.

The cooling plate may include a body disposed in the groove of the casing, a mounting groove formed radially inside the body, a pair of side walls extending outward from both sides on a radially outer peripheral surface of the body, and the fin extending upward from an outer peripheral surface of the body.

The fin may be in a form of a rib disposed in the center between the pair of side walls.

The fin may be higher than radial heights of the side walls.

The cooling plate may further include mounting ribs extending outwardly from upper ends of the pair of side walls.

The fin may include two or more ribs formed between the pair of side walls.

The fin may include two ribs having a same height as the side wall and formed between the pair of side walls, and one rib having a height lower than that of the two ribs and formed between the two ribs.

The fin may be in a form of a rib disposed in a center between the pair of side walls, and may include a through-hole formed in a middle of the rib.

The through-hole may be formed to be inclined at a predetermined angle with respect to a width direction of the cooling plate.

The pair of side walls may have grooves or holes formed on inner surfaces thereof.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
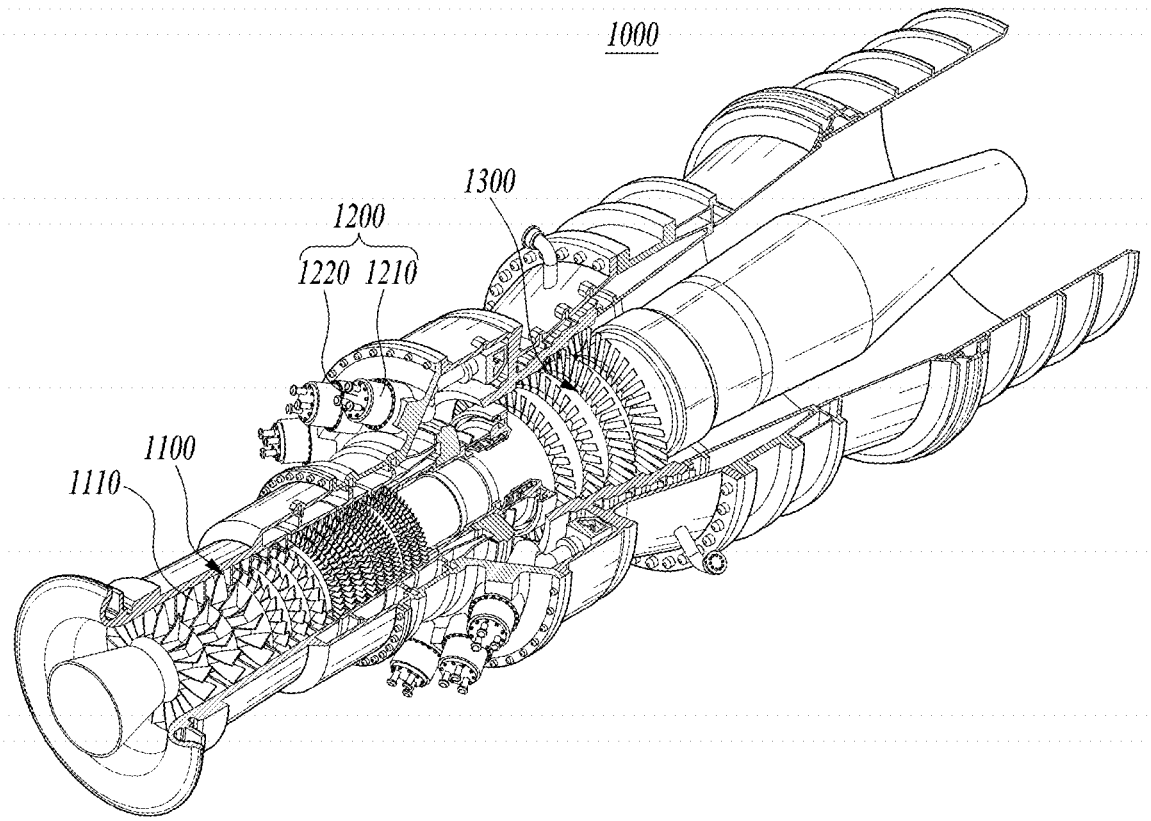
FIG. 1 is a partial cutaway perspective view illustrating a gas turbine according to an exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, a tip clearance control apparatus and a gas turbine including the same according to exemplary embodiments will be described below in detail with reference to the accompanying drawings. It should be noted that like reference numerals refer to like parts throughout the specification. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
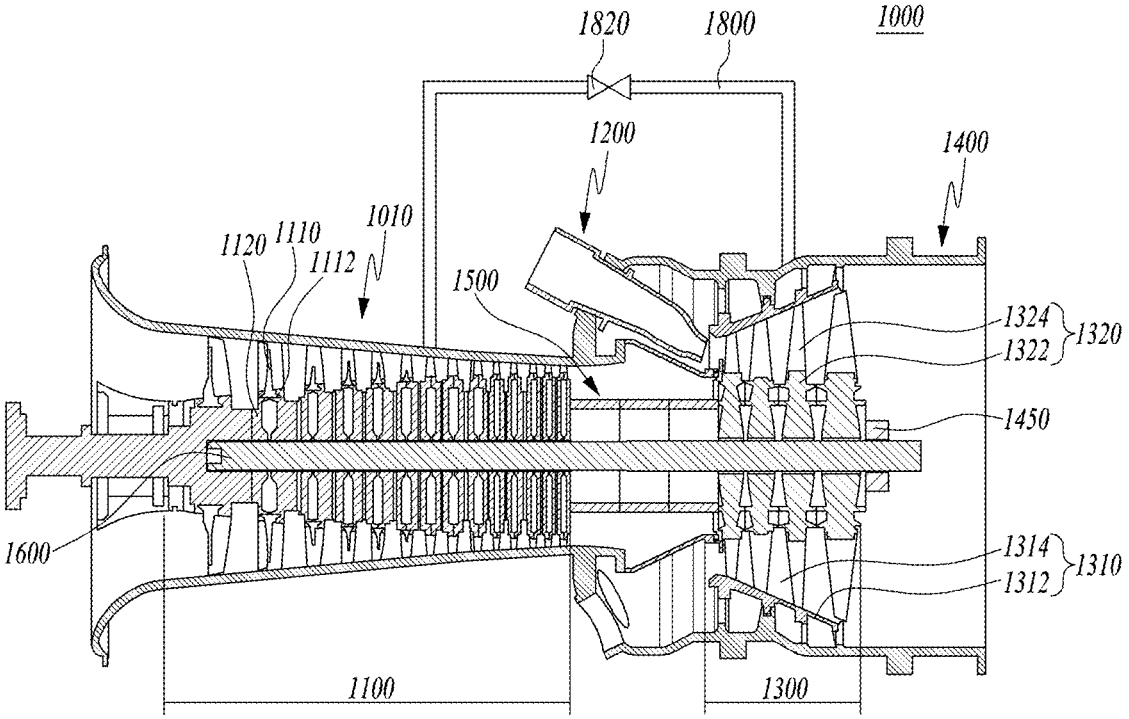
FIG. 2 is a cross-sectional view illustrating a schematic structure of the gas turbine according to the exemplary embodiment.
Figure 3:
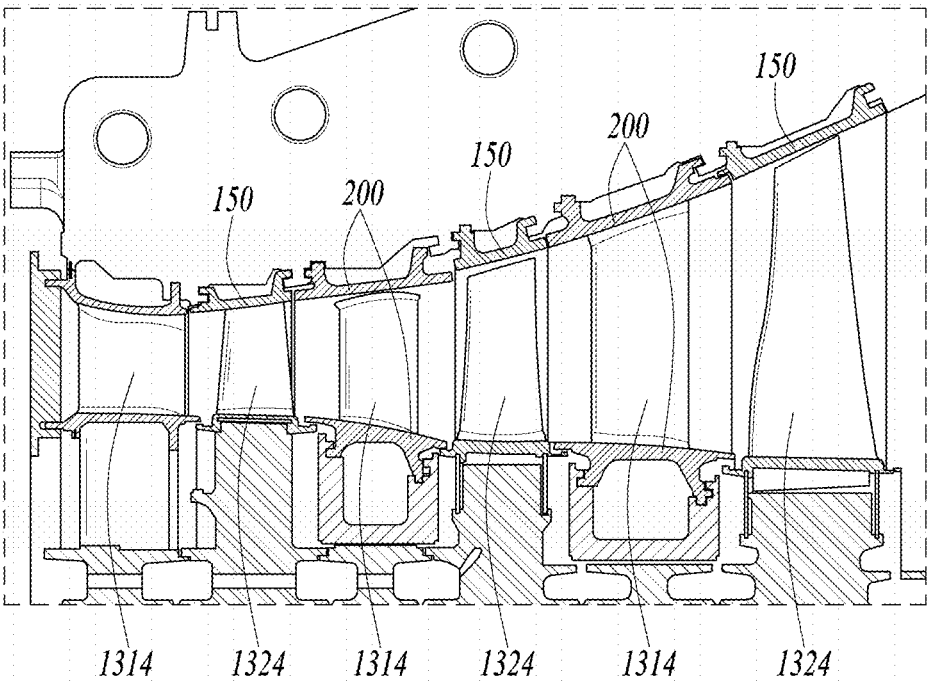
FIG. 3 is a partial cross-sectional view illustrating an internal structure of the gas turbine according to the exemplary embodiment.

FIG. 1 is a partial cutaway perspective view illustrating a gas turbine according to an exemplary embodiment. FIG. 2 is a cross-sectional view illustrating a schematic structure of the gas turbine according to the exemplary embodiment. FIG. 3 is a partial cross-sectional view illustrating an internal structure of the gas turbine according to the exemplary embodiment.

Referring to FIG. 1, the gas turbine 1000 according to the exemplary embodiment includes a compressor 1100, a combustor 1200, and a turbine 1300. The compressor 1100 including a plurality of blades 1110 arranged radially rotates the plurality of blades 1110, and air is compressed by the rotation of the plurality of blades 1110 and flows. A size and installation angle of each of the blades 1110 may vary depending on an installation position thereof. The compressor 1100 may be directly or indirectly connected to the turbine 1300, to receive some of the power generated by the turbine 1300 and use the received power to rotate the blades 1110.

The air compressed by the compressor 1100 flows to the combustor 1200. The combustor 1200 includes a plurality of combustion chambers 1210 and fuel nozzle modules 1220 arranged annularly.

Referring to FIG. 2, the gas turbine 1000 according to the exemplary embodiment includes a housing 1010 and a diffuser 1400 disposed behind the housing 1010 to discharge the combustion gas passing through the turbine 1300. The combustor 1200 is disposed in front of the diffuser 1400 to combust the compressed air supplied thereto.

Based on the direction of an air flow, the compressor 1100 is disposed at an upstream, and the turbine 1300 is disposed at a downstream side. A torque tube 1500 serving as a torque transmission member for transmitting the rotational torque generated in the turbine 1300 to the compressor 1100 is disposed between the compressor 1100 and the turbine 1300.

The compressor 1100 includes a plurality of compressor rotor disks 1120, each of which is fastened by a tie rod 1600 to prevent axial separation in an axial direction of the tie rod 1600.

For example, the compressor rotor disks 1120 are axially aligned in a state in which the tie rod 1600 forming a rotary shaft passes through the centers of the compressor rotor disks 1120. Here, adjacent compressor rotor disks 1120 are arranged so that facing surfaces thereof are in tight contact with each other by being pressed by the tie rod 1600. The adjacent compressor rotor disks 1120 cannot rotate because of this arrangement.

Each of the compressor rotor disks 1120 has a plurality of blades 1110 radially coupled to an outer peripheral surface thereof. Each of the blades 1110 has a dovetail 1112 fastened to the compressor rotor disk 1120.

A plurality of vanes are fixedly arranged between each of the compressor rotor disks 1120 in the housing 1010. While the compressor rotor disks 1120 rotate along with a rotation of the tie rod 1600, the vanes fixed to the housing 1010 do not rotate. The vanes guide the flow of the compressed air moved from front-stage blades 1110 to rear-stage blades 1110.

The dovetail 1112 may be fastened by a tangential type or an axial type, which may be selected according to a structure of a gas turbine. The dovetail 1112 may have a dovetail shape or a fir-tree shape. In some cases, the blades 1110 may be fastened to the compressor rotor disks 1120 by using other types of fastening members such as a key or a bolt.

The tie rod 1600 is disposed to pass through the centers of the plurality of compressor rotor disks 1120 and turbine rotor disks 1322. The tie rod 1600 may be a single tie rod or a plurality of tie rods. One end of the tie rod 1600 is fastened to a most upstream compressor rotor disk, and the other end thereof is fastened by a fixing nut 1450.

It is understood that the type of the tie rod 1600 may not be limited to the example illustrated in FIG. 2, and may be changed or vary according to one or more other exemplary embodiments. For example, a single tie rod may be disposed to pass through the centers of the rotor disks, a plurality of tie rods may be arranged circumferentially, or a combination thereof may be used.

Also, in order to increase the pressure of fluid and adjust an actual inflow angle of the fluid, entering into an inlet of the combustor, a deswirler serving as a guide vane may be installed at the rear stage of the diffuser of the compressor 1100 so that the actual inflow angle matches a designed inflow angle.

The combustor 1200 mixes fuel with the introduced compressed air, burns a fuel-air mixture to produce high-temperature and high-pressure combustion gas with high energy, and increases the temperature of the combustion gas to a temperature at which the combustor and the turbine components are able to be resistant to heat through an isobaric combustion process.

A plurality of combustors constituting the combustor 1200 may be arranged in the housing in a form of a cell. Each of the combustors may include a burner having a fuel injection nozzle and the like, a combustor liner defining a combustion chamber, and a transition piece serving as a connection between the combustor and the turbine.

The combustor liner provides a combustion space in which the fuel injected by the fuel injection nozzle is mixed with the compressed air supplied from the compressor. The combustor liner may include a flame container providing the combustion space in which the mixture of air and fuel is burned, and a flow sleeve defining an annular space while surrounding the flame container. The fuel injection nozzle is coupled to a front end of the combustor liner, and an ignition plug is coupled to a side wall of the combustor liner.

The transition piece is connected to a rear end of the combustor liner to transfer the combustion gas toward the turbine. An outer wall of the transition piece is cooled by the compressed air supplied from the compressor to prevent the transition piece from being damaged due to the high temperature of the combustion gas.

To this end, the transition piece has cooling holes through which the compressed air is injected, and the compressed air cools the inside of the transition piece and then flows toward the combustor liner.

The compressed air that has cooled the transition piece may flow into an annular space of the combustor liner, and may be supplied as a cooling air through the cooling holes formed in the flow sleeve from the outside of the flow sleeve to an outer wall of the combustor liner.

The high-temperature and high-pressure combustion gas ejected from the combustor 1200 is supplied to the turbine 1300. The supplied high-temperature and high-pressure combustion gas expands and applies impingement or reaction force to the turbine blades to generate rotational torque. A portion of the obtained rotational torque is transmitted via the torque tube to the compressor, and the remaining portion which is the excessive torque is used to drive a generator or the like.

The turbine 1300 basically has a structure similar to the compressor 1100. That is, the turbine 1300 includes a turbine rotor 1320 similar to the rotor of the compressor 1100. The turbine rotor 1320 includes a plurality of turbine rotor disks 1322 and a plurality of turbine blades 1324 arranged radially. The turbine blades 1324 may be coupled to the turbine rotor disk 1322 in a dovetail coupling manner or the like.

In addition, a plurality of turbine vanes 1314 fixed to a turbine casing 1312 are provided between the turbine blades 1324 of the turbine rotor disk 1322 to guide a flow direction of the combustion gas passing through the turbine blades 1324. In this case, the turbine casing 1312 and the turbine vanes 1314 corresponding to a fixing body may be collectively referred to as a turbine stator 1310 in order to distinguish them from the turbine rotor 1320 corresponding to a rotating body.

Referring to FIG. 3, the turbine vanes 1314 are fixedly mounted in the turbine casing 1312 by a vane carrier 200, which is an endwall coupled to inner and outer ends of each of the turbine vanes 1314. On the other hand, a ring segment 150 is mounted to the inner surface of the turbine casing at a position facing the outer end of each of the turbine blades 1324, with a predetermined gap. That is, the gap formed between the ring segment 130 and the outer end of the turbine blade 1324 is defined as a tip clearance.

Referring back to FIG. 2, the turbine blade 1324 comes into direct contact with high-temperature and high-pressure combustion gas. The turbine blade 1324 may be deformed by the combustion gas, and the turbine 1300 may be damaged by the deformation of the turbine blade 1324. In order to prevent deformation due to such high temperature, a branch passage 1800 may be formed between the compressor 1100 and the turbine 1300 so that a part of the air having a temperature relatively lower than that of the combustion gas may be branched into the compressor 1100 and supplied to the turbine blade 1324.

The branch passage 1800 may be formed outside the compressor casing or may be formed inside the compressor casing by passing through the compressor rotor disk 1120. The branch passage 1800 may supply the compressed air branched from the compressor 1100 into the turbine rotor disk 1322. The compressed air supplied into the turbine rotor disk 1322 flows radially outward, and may be supplied into the turbine blade 1324 to cool the turbine blade 1324. In addition, the branch passage 1800 connected to the outside of the housing 1010 may supply the compressed air branched from the compressor 1100 into the turbine casing 1312 to cool the inside of the turbine casing 1312. The branch passage 1800 may be provided with a valve 1820 in a middle thereof to selectively supply compressed air. The branch passage 1800 may be connected to a heat exchanger to selectively further cool the compressed air prior to supply.

Figure 4:
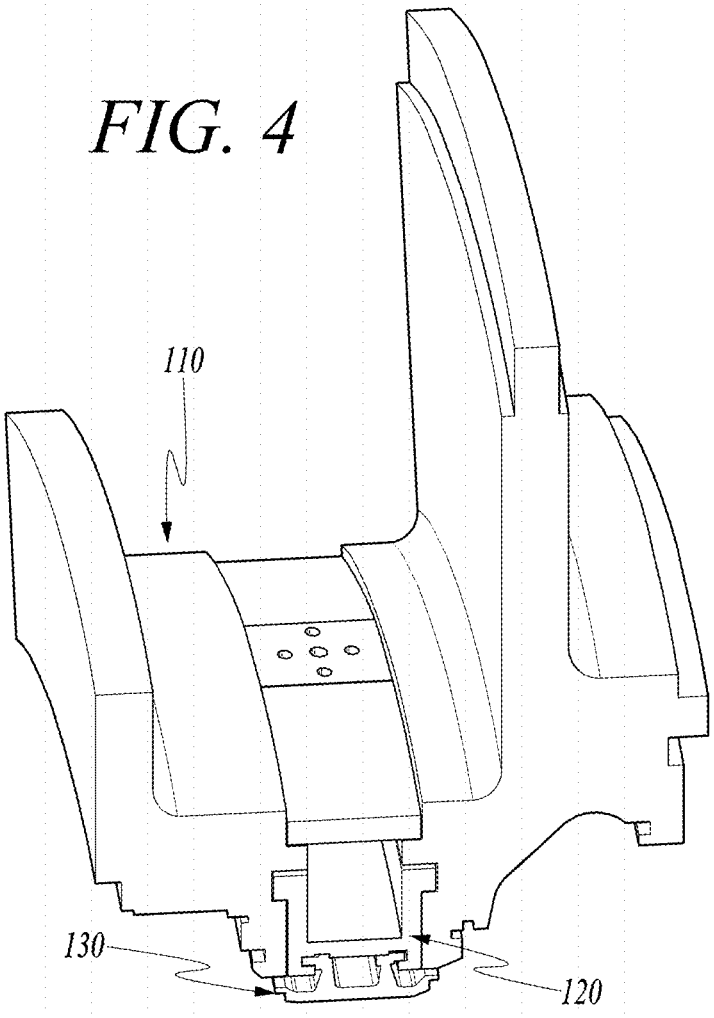
FIG. 4 is a perspective view illustrating a tip clearance control apparatus according to an exemplary embodiment.
Figure 5:
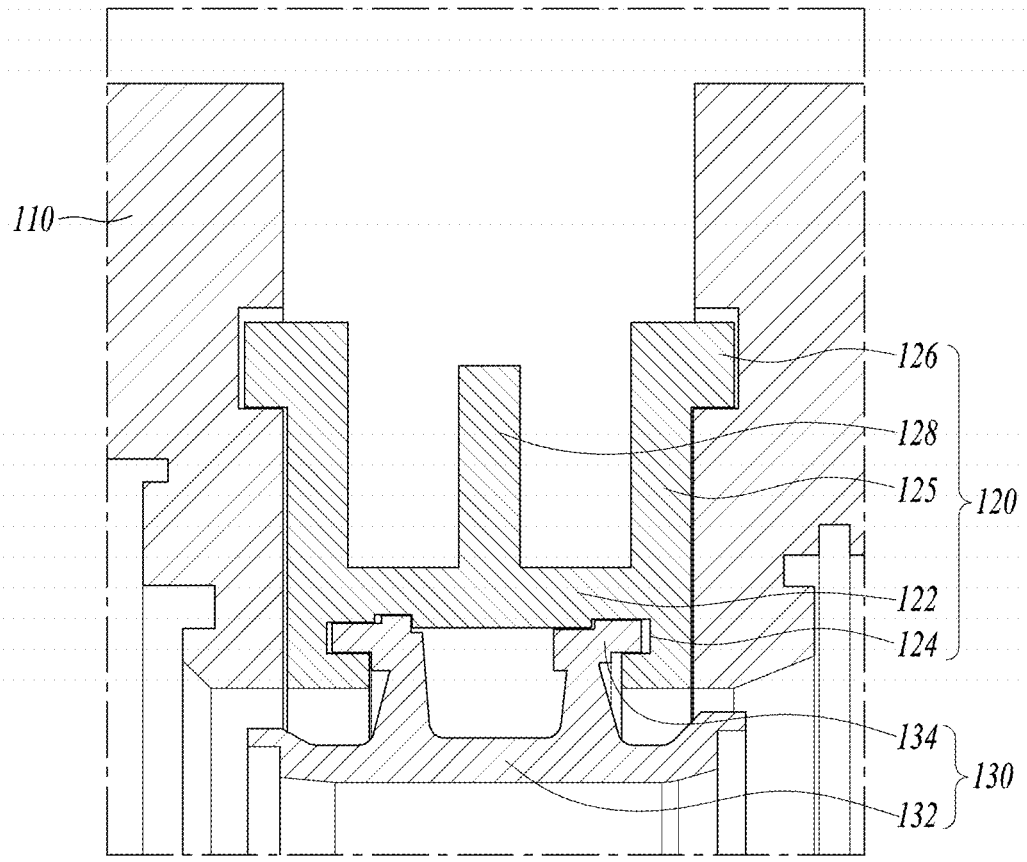
FIG. 5 is a cross-sectional view illustrating the tip clearance control apparatus according to the exemplary embodiment.

FIG. 4 is a perspective view illustrating a tip clearance control apparatus according to an exemplary embodiment. FIG. 5 is a cross-sectional view illustrating the tip clearance control apparatus according to the exemplary embodiment.

Referring to FIGS. 4 and 5, the tip clearance control apparatus according to the exemplary embodiment may include a casing 110 surrounding a turbine blade 1324, and a cooling plate 120 installed in a groove and formed in a circumferential direction in the casing and contracted by the supplied cold air, the cooling plate 120 having at least one fin 128 formed on an outer peripheral surface thereof, and a ring segment 130 mounted radially inside the cooling plate 120.

The casing 110 is a turbine casing disposed to be spaced apart from the ends of a plurality of turbine blades 1324 by a predetermined distance. The groove may be formed in a circumferential direction at a position in which each ring segment 130 is mounted in the casing 110.

The cooling plate 120 may be installed in the groove of the casing 110, and may be formed of a plurality of segments arranged in the circumferential direction. FIGS. 4 and 5 illustrate that mounting ribs 126 are formed at both upper ends of side walls 125 of the cooling plate 120. However, it is understood that the mounting ribs 126 may not be limited to the example illustrated in FIGS. 4 and 5, and may be changed or vary according to one or more other exemplary embodiments. For example, the cooling plate 120 includes a plurality of segments which may each be radially supported on the circumferential side, and even if there is no mounting rib, the segments of the cooling plate 120 may be fixedly mounted in the groove of the casing 110.

The ring segment 130 may be mounted in a mounting structure provided radially inside the cooling plate 120. The ring segment 130 may include a body 132 in a form of a plate bent in a circumferential direction, and a mounting rib portion 134 extending outward from the radially outer surface of the body 132 and then extending axially outward.

The cooling plate 120 may include a body 122 disposed in the groove of the casing 110, a mounting groove 124 formed radially inside the body 122, a pair of side walls 125 extending outwardly from both sides on the radially outer peripheral surface of the body, and a fin 128 extending upward from the outer peripheral surface of the body 122.

The body 122 may be in a form of an arc-shaped plate segment bent in the circumferential direction.

The mounting groove 124 is formed radially inside the body 122. The mounting groove 124 may form a groove for inserting the mounting rib portion 134 of the ring segment 130, in a manner that extends radially inward from both axial edges of the inner peripheral surface and bends so that inner ends thereof face each other.

The pair of side walls 125 may be in a form of a rib extending outwardly from both edges on the radially outer peripheral surface of the body 122. As described above, the mounting rib 126 may or may not be formed on the axially outside the upper end of each side wall 125.

The fin 128 may be disposed in a center between the pair of side walls 125 and may be in a form of a rib extending radially outwardly. The fin 128 enables efficient delivery of cold compressed air from the outside of the casing 110 to the cooling plate 120.

Here, the pair of side walls 125 are referred to as side walls because they extend from the edge of the body 122 and are in contact with the inner surface of the groove of the casing 110. However, the side walls 125 may be in the form of a rib such as a fin 128 to serve as a cooling fin to which cold air is supplied.

Figure 6A:
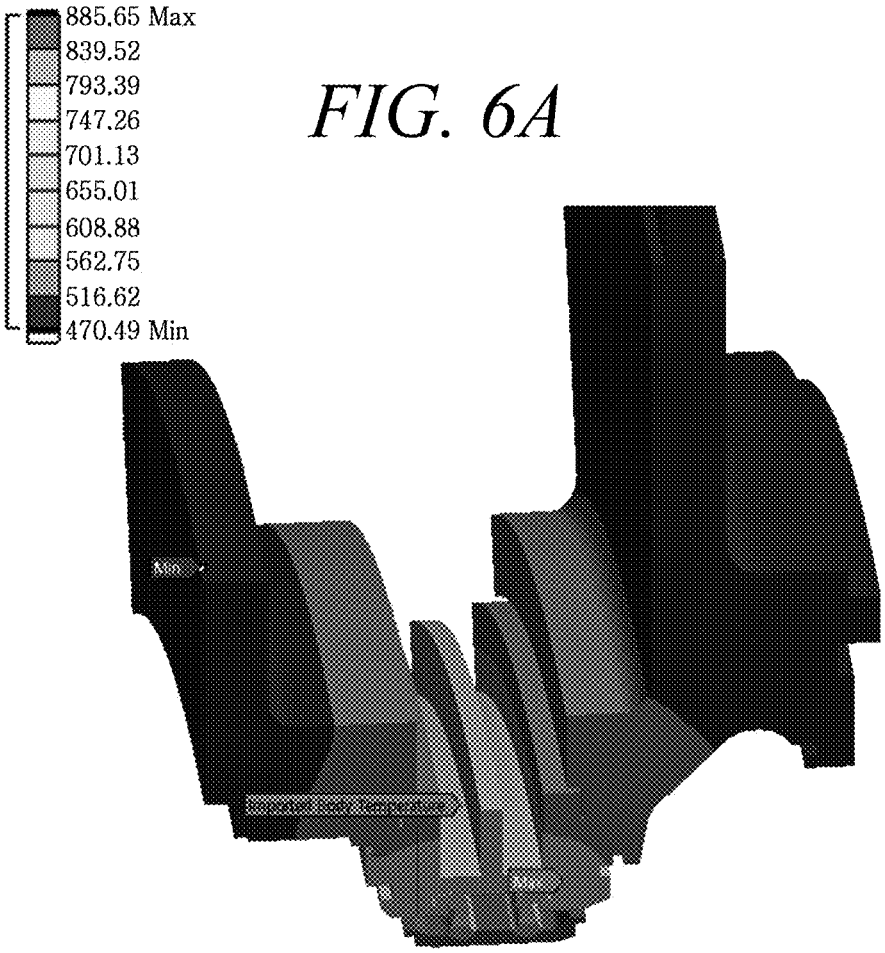
FIG. 6A is a view illustrating a temperature distribution before supplying cold air to the tip clearance control apparatus according to an exemplary embodiment.
Figure 6B:
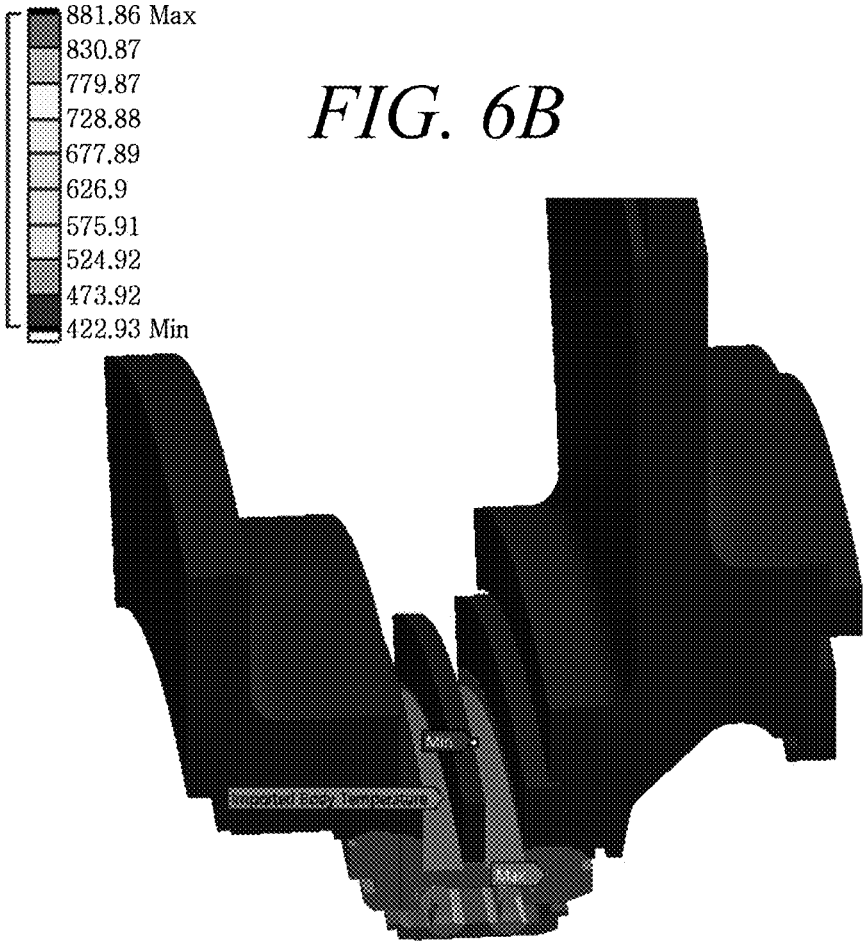
FIG. 6B is a view illustrating a temperature distribution after supplying cold air to the tip clearance control apparatus according to an exemplary embodiment.
Figure 7A:
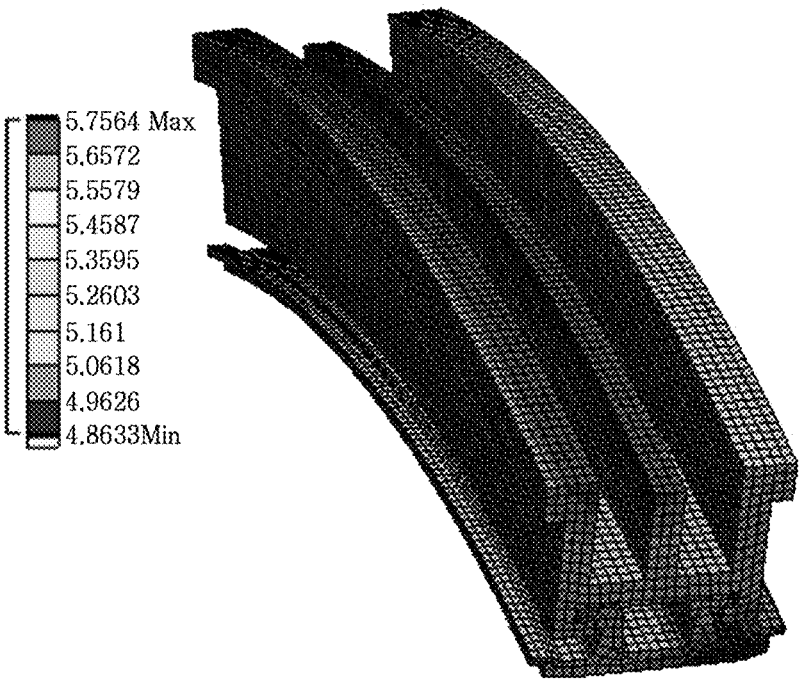
FIG. 7A is a view illustrating an amount of radial deformation of the cooling plate before supplying cold air to the tip clearance control apparatus according to an exemplary embodiment.
Figure 7B:
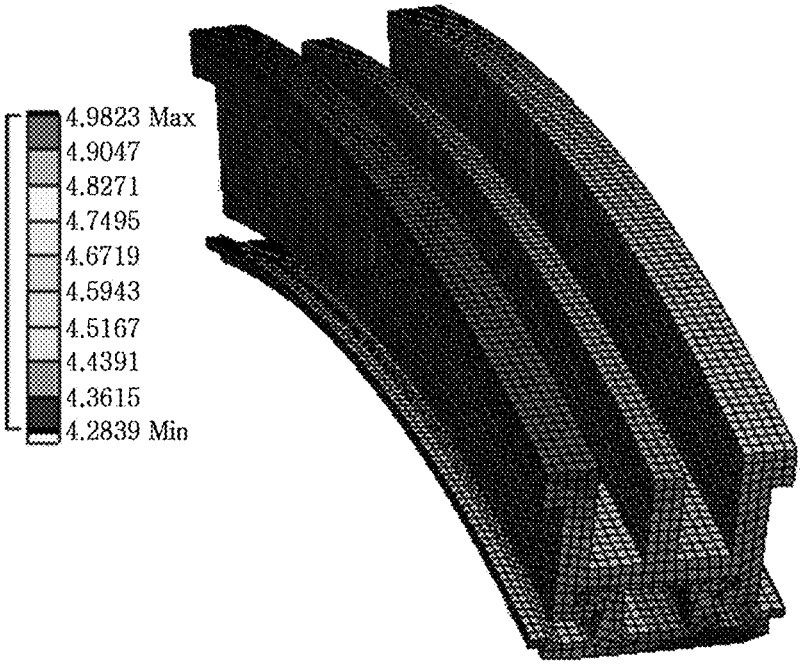
FIG. 7B is a view illustrating an amount of radial deformation of the cooling plate after supplying cold air to the tip clearance control apparatus according to an exemplary embodiment.
Figure 8A:
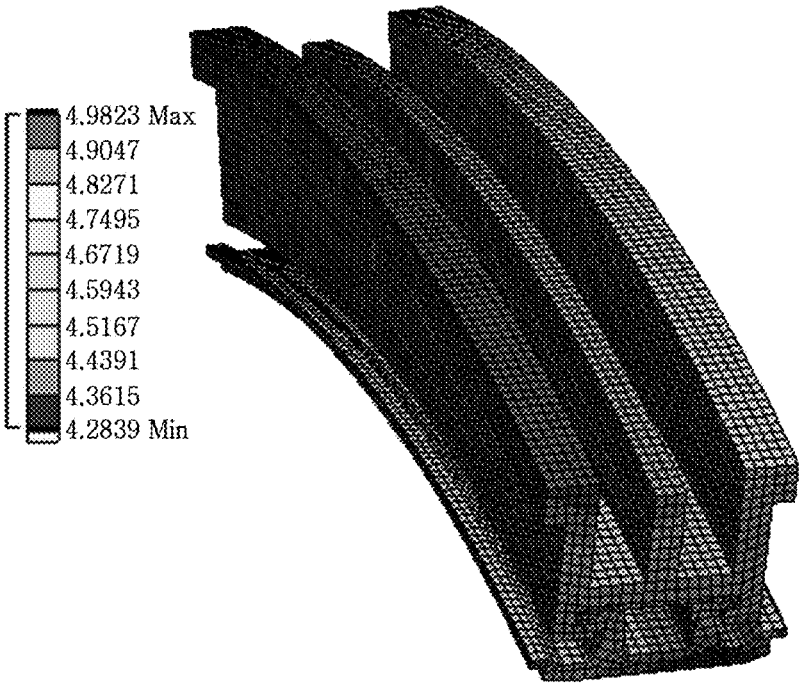
FIG. 8A is a view illustrating an amount of radial deformation of the cooling plate when a fin of the cooling plate is low in height.
Figure 8B:
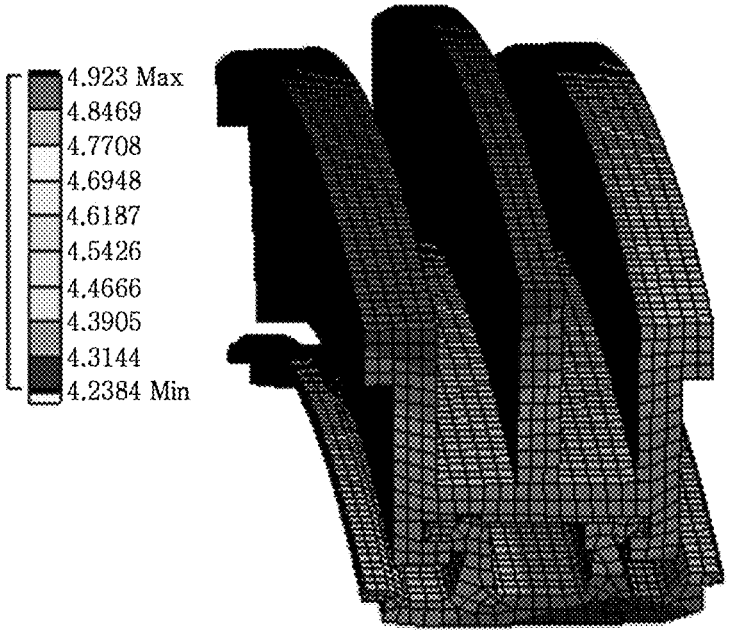
FIG. 8B is a view illustrating an amount of radial deformation of the cooling plate when the fin of the cooling plate is high in height.

FIG. 6A is a view illustrating a temperature distribution before supplying cold air to the tip clearance control apparatus according to an exemplary embodiment, and FIG. 6B is a view illustrating a temperature distribution after supplying cold air to the tip clearance control apparatus according to the exemplary embodiment. FIG. 7A is a view illustrating an amount of radial deformation of the cooling plate before supplying cold air to the tip clearance control apparatus according to an exemplary embodiment, and FIG. 7B is a view illustrating an amount of radial deformation of the cooling plate after supplying cold air to the tip clearance control apparatus according to an exemplary embodiment. FIG. 8A is a view illustrating an amount of radial deformation of the cooling plate when the fin of the cooling plate is low in height, and FIG. 8B is a view illustrating an amount of radial deformation of the cooling plate when the fin of the cooling plate is high in height.

Referring to FIG. 6A, when the gas turbine is operated without supplying cold air to the tip clearance control apparatus, the temperature distribution showed that the lowest temperature inside the ring segment 130 was about 470° C. and the highest temperature outside the casing 110 was about 886° C.

Referring to FIG. 6B, when the gas turbine is operated while supplying cold air to the tip clearance control apparatus, the temperature distribution showed that the lowest temperature outside the casing 110 was about 422° C. and the highest temperature inside the ring segment 130 was about 882° C. As such, when the cooling plate is cooled, it contracts radially inward. Therefore, it is possible to reduce the tip clearance between the end of the turbine blade and the ring segment mounted on the cooling plate.

Referring to FIG. 7A, when the gas turbine is operated without supplying cold air to the cooling plate 120, it can be seen that the minimum displacement of the inner end of the ring segment 130 is about 4.86 mm and the maximum displacement of the outer end of the cooling plate 120 is about 5.76 mm in the distribution of the amount of deformation in the radial direction of the cooling plate 120 and the ring segment 130.

Referring to FIG. 7B, when the gas turbine is operated while supplying cold air to the cooling plate 120, it can be seen that the minimum displacement of the inner end of the ring segment 130 is about 4.28 mm and the maximum displacement of the outer end of the cooling plate 120 is about 4.98 mm in the distribution of the amount of deformation in the radial direction of the cooling plate 120 and the ring segment 130.

Accordingly, the tip clearance control apparatus can control the amount of radial deformation of the cooling plate such that the cooling plate is displaced at a minimum of about 0.58 mm and a maximum of about 0.78 mm depending on whether cold air is supplied.

Referring to FIG. 8A, a radial height of the fin 128 of the cooling plate 120 may be slightly smaller than radial heights of the side walls 125. In this case, when the gas turbine is operated while supplying cold air to the cooling plate 120, it can be seen that the minimum displacement of the inner end of the ring segment 130 is about 4.28 mm and the maximum displacement of the outer end of the cooling plate 120 is about 4.98 mm in the distribution of the amount of deformation in the radial direction of the cooling plate 120 and the ring segment 130.

Referring to FIG. 8B, the radial height of the fin 128 of the cooling plate 120 may be greater than the radial heights of the side walls 125. In this case, when the gas turbine is operated while supplying cold air to the cooling plate 120, it can be seen that the minimum displacement of the inner end of the ring segment 130 is about 4.24 mm and the maximum displacement of the outer end of the cooling plate 120 is about 4.92 mm in the distribution of the amount of deformation in the radial direction of the cooling plate 120 and the ring segment 130.

In this case, the tip clearance control apparatus can control the amount of radial deformation of the cooling plate such that the cooling plate is displaced at a maximum of about 0.84 mm depending on whether cold air is supplied. That is, it can be seen that the higher the radial height of the fin 128 is, the more cold air is delivered and thus more contraction occurs.

Figure 9A:
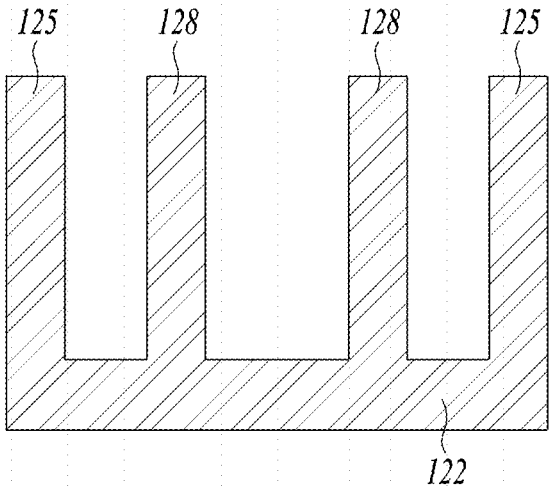
FIGS. 9A and 9B are cross-sectional views illustrating examples in which a plurality of fins are formed on a cooling plate.
Figure 9B:
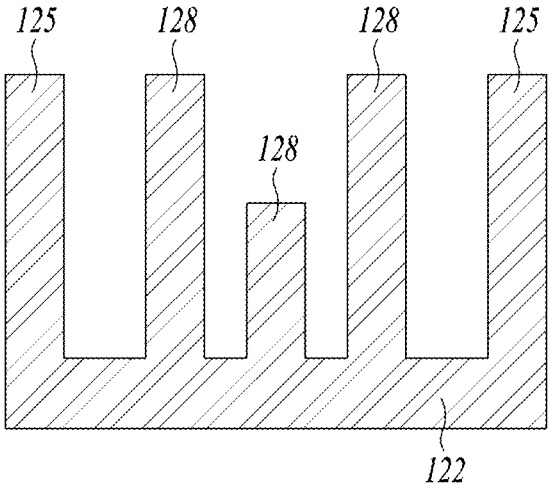
Figure 10A:
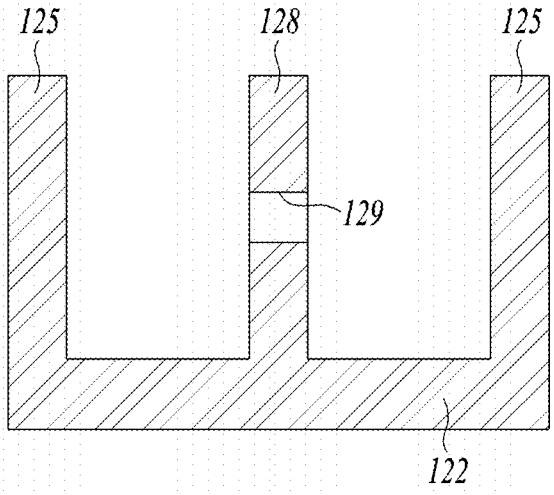
FIGS. 10A and 10B are cross-sectional views illustrating examples in which a through-hole is formed in a fin of a cooling fin.
Figure 10B:
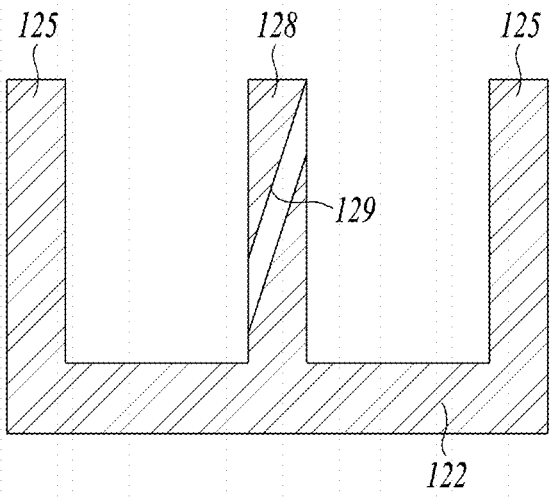
Figure 11A:
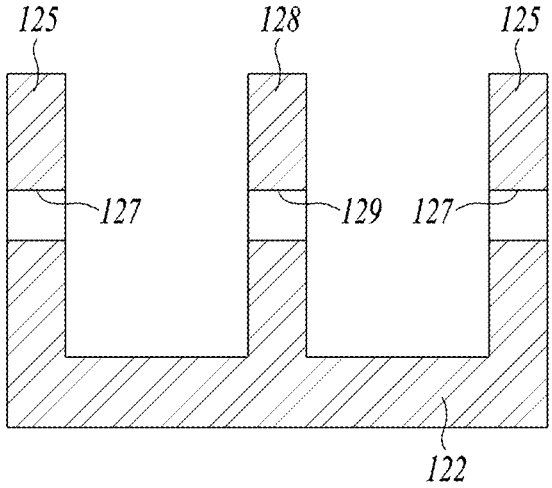
FIGS. 11A and 11B are cross-sectional views illustrating examples in which a cooling plate has a through-hole formed in a fin and holes or grooves formed on side walls.
Figure 11B:
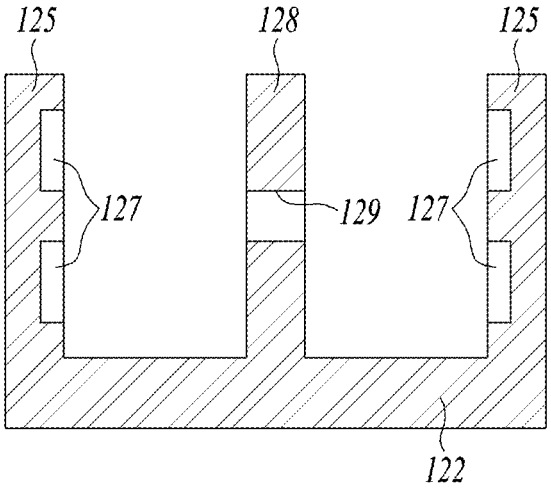

FIGS. 9A and 9B are cross-sectional views illustrating examples in which a plurality of fins are formed on a cooling plate. FIGS. 10A and 10B are cross-sectional views illustrating examples in which a through-hole is formed in a fin of a cooling fin. FIGS. 11A and 11B are cross-sectional views illustrating examples in which a cooling plate has a through-hole formed in a fin and holes or grooves formed on side walls.

Referring to FIGS. 9A and 9B, a plurality of fins 128 may be formed on a cooling plate 120. That is, the fins 128 may include two or more ribs formed between a pair of side walls 125.

In FIG. 9A, two fins 128 may be disposed between the pair of side walls 125. In this case, it can be seen that no mounting rib is formed on the axial outer surfaces of the pair of side walls 125. The fins 128 may be formed to have the same radial height as the pair of side walls 125. It is understood that the heights of the fins 128 may be higher or lower than the side walls 125.

In FIG. 9B, two rib-shaped fins 128 having the same height as the side wall 125 may be formed between the pair of side walls 125, and one rib-shaped fin 128 having a height lower than that of the side wall 125 may be formed between the two rib-shaped fins 128.

Referring to FIGS. 9A and 9B, when two or more fins 128 are disposed between the pair of side walls 125, the cooling plate 120 may absorb a larger amount of cold air to further contract due to a larger number of cooling fins including the side walls 125 and the fins 128.

Referring to FIGS. 10A and 10B, a through-hole 129 may be formed in a fin 128 of a cooling plate 120.

In FIG. 10A, the through-hole 129 may be formed in an axial direction, that is, in a direction perpendicular to the fin 128. When the through-hole 129 is formed in the fin 128, cold air can be efficiently delivered.

In FIG. 10B, the through-hole 129 may be formed in the fin 128 to be inclined at a predetermined angle with respect to the width direction of the cooling plate 120. When the through-hole 129 is obliquely formed, the delivery path of cold air is further extended, which can lead to more efficient delivery of cold air.

In addition, even when the plurality of fins 128 are disposed as illustrated in FIGS. 9A and 9B, a through-hole 129 may be formed in each fin 128.

Referring to FIGS. 11A and 11B, a cooling plate 120 has a through-hole 129 formed in a fin 128 and grooves or holes 127 formed on the inner surfaces of a pair of side walls 125.

In FIG. 11A, the through-hole 129 may be vertically formed in the fin 128, and the holes 127 may be formed through the pair of side walls 125. The holes 127 of the side walls 125 may be close contact with the inner surface of the casing 110 to be clogged. Because the pair of side walls 125 also serve as cooling fins, forming the holes 127 in the side walls 125 may improve cold air delivery capability.

In FIG. 11B, the through-hole 129 may be vertically formed in the fin 128, and the grooves 127 may be formed on the inner surfaces of the pair of side walls 125. Two or more grooves 127 having different radial heights may be formed on the inner surfaces of the side walls 125. Each groove 127 may extend in a circumferential direction, or a plurality of grooves may be arranged in the circumferential direction at predetermined intervals.

When the gas turbine starts to operate, the turbine blade 1324 heats up rapidly. Accordingly, the tip clearance between the ring segment 130 and the turbine blade 1324 becomes small. Therefore, at the time of starting, heated air is supplied to the cooling plate 120 to move the ring segment 130 radially outward, thereby preventing the end of the turbine blade 1324 from contacting the ring segment 130.

Because the tip clearance increases under normal conditions when the gas turbine is operated at a constant rotational speed, cold air is supplied to the cooling plate 120 to move the ring segment 130 radially inward, thereby keeping the tip clearance small at an appropriate interval.

As described above, according to the apparatus for controlling turbine blade tip clearance and the gas turbine including the same, because the shape of the cooling plate has been improved to supply cold air more efficiently, the cooling plate can contract further in the radial direction.

Accordingly, the ring segment mounted on the cooling plate can move further in the radial direction, and the turbine blade tip clearance can be adjusted over a wider range.

While one or more exemplary embodiments have been described with reference to the accompanying drawings, it will be apparent to those skilled in the art that various variations and modifications in form and details may be made by adding, changing, or removing components without departing from the spirit and scope of the disclosure as defined in the appended claims, and these variations and modifications fall within the spirit and scope of the disclosure as defined in the appended claims. Accordingly, the description of the exemplary embodiments should be construed in a descriptive sense only and not to limit the scope of the claims, and many alternatives, modifications, and variations will be apparent to those skilled in the art.

What is claimed is:

1. An apparatus for controlling tip clearance between a turbine casing and a turbine blade, the apparatus comprising:

a casing surrounding the turbine blade;

a cooling plate installed in a groove, formed in a circumferential direction in the casing, and contracted by cold air supplied thereto, the cooling plate having at least one fin formed on an outer peripheral surface thereof; and a ring segment mounted radially inside the cooling plate.

2. The apparatus according to claim 1, wherein the cooling plate comprises a body disposed in the groove of the casing, a mounting groove formed radially inside the body, a pair of side walls extending outward from both sides on a radially outer peripheral surface of the body, and the fin extending upward from an outer peripheral surface of the body.

3. The apparatus according to claim 2, wherein the fin is in a form of a rib disposed in a center between the pair of side walls.

4. The apparatus according to claim 3, wherein the fin is higher than radial heights of the side walls.

5. The apparatus according to claim 2, wherein the cooling plate further comprises mounting ribs extending outwardly from upper ends of the pair of side walls.

6. The apparatus according to claim 2, wherein the fin includes two or more ribs formed between the pair of side walls.

7. The apparatus according to claim 6, wherein the fin includes two ribs having a same height as the side wall and formed between the pair of side walls, and one rib having a height lower than that of the two ribs and formed between the two ribs.

8. The apparatus according to claim 2, wherein the fin is in a form of a rib disposed in a center between the pair of side walls, and comprises a through-hole formed in a middle of the rib.

9. The apparatus according to claim 8, wherein the through-hole is formed to be inclined at a predetermined angle with respect to a width direction of the cooling plate.

10. The apparatus according to claim 8, wherein the pair of side walls have grooves or holes formed on inner surfaces thereof.

11. A gas turbine comprising:

a compressor configured to compress outside air;

a combustor configured to mix fuel with the air compressed by the compressor to burn a mixture thereof;

a turbine comprising a plurality of turbine blades in a turbine casing rotated by combustion gas discharged from the combustor to generate power; and an apparatus for controlling tip clearance between the turbine casing and the turbine blade, wherein the apparatus for controlling tip clearance comprises:

a casing surrounding the turbine blade;

a cooling plate installed in a groove, formed in a circumferential direction in the casing, and contracted by cold air supplied thereto, the cooling plate having at least one fin formed on an outer peripheral surface thereof; and a ring segment mounted radially inside the cooling plate.

12. The gas turbine according to claim 11, wherein the cooling plate comprises a body disposed in the groove of the casing, a mounting groove formed radially inside the body, a pair of side walls extending outward from both sides on a radially outer peripheral surface of the body, and the fin extending upward from an outer peripheral surface of the body.

13. The gas turbine according to claim 12, wherein the fin is in a form of a rib disposed in a center between the pair of side walls.

14. The gas turbine according to claim 13, wherein the fin is higher than radial heights of the side walls.

15. The gas turbine according to claim 12, wherein the cooling plate further comprises mounting ribs extending outwardly from upper ends of the pair of side walls.

16. The gas turbine according to claim 12, wherein the fin includes two or more ribs formed between the pair of side walls.

17. The gas turbine according to claim 16, wherein the fin includes two ribs having a same height as the side wall and formed between the pair of side walls, and one rib having a height lower than that of the two ribs and formed between the two ribs.

18. The gas turbine according to claim 12, wherein the fin is in a form of a rib disposed in a center between the pair of side walls, and comprises a through-hole formed in a middle of the rib.

19. The gas turbine according to claim 18, wherein the through-hole is formed to be inclined at a predetermined angle with respect to a width direction of the cooling plate.

20. The gas turbine according to claim 18, wherein the pair of side walls have grooves or holes formed on inner surfaces thereof.

* * * * *